United States Patent [19]

Alten

[11] Patent Number: 4,732,203

[45] Date of Patent: Mar. 22, 1988

[54] SECTIONAL DOOR WITH OPERATOR

[76] Inventor: Kurt Alten, Ringstr. 14, D-3015 Wennigsen, Fed. Rep. of Germany

[21] Appl. No.: 925,160

[22] Filed: Oct. 31, 1986

[30] Foreign Application Priority Data

Nov. 2, 1985 [DE] Fed. Rep. of Germany ..... 3538947

[51] Int. Cl.[4] ..... E05F 15/00

[52] U.S. Cl. ..... 160/188; 160/201

[58] Field of Search ..... 160/188, 201, 207, 208; 49/358, 360, 362

[56] References Cited

U.S. PATENT DOCUMENTS

| | | | |
|---|---|---|---|
| 1,916,652 | 7/1933 | Beeman et al. | 49/139 X |
| 2,790,635 | 4/1957 | Evans et al. | 160/188 |
| 2,794,634 | 6/1957 | Bragg | 74/89.14 |
| 2,925,267 | 2/1960 | Volf | 160/188 |
| 3,202,415 | 8/1965 | Lodge | 160/188 X |
| 3,289,350 | 12/1966 | Moody | 49/358 X |
| 3,797,171 | 3/1974 | Farmer | 160/188 X |
| 3,934,635 | 1/1976 | Kin | 160/189 |

*Primary Examiner*—Ramon S. Britts
*Assistant Examiner*—David M. Purol
*Attorney, Agent, or Firm*—Becker & Becker, Inc.

[57] ABSTRACT

The doors of a type including closure elements are guided at the side and which are provided with a drive mechanism. To simplify the drive mechanism, and to increase the operational reliability, there are inventively provided one or more motors that are secured to the closure elements and that have a gear wheel which meshes with a track that extends parallel to the lateral guide rails. Preferably, the gear wheels and the lateral guide rollers are coaxially disposed, with the guide rollers being freely rotatable.

6 Claims, 4 Drawing Figures

FIG-1
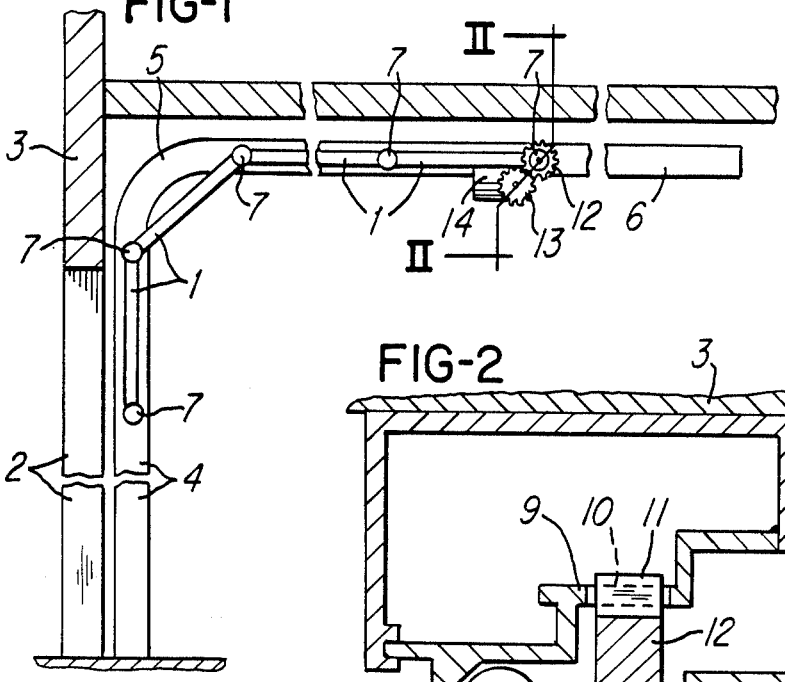
FIG-2
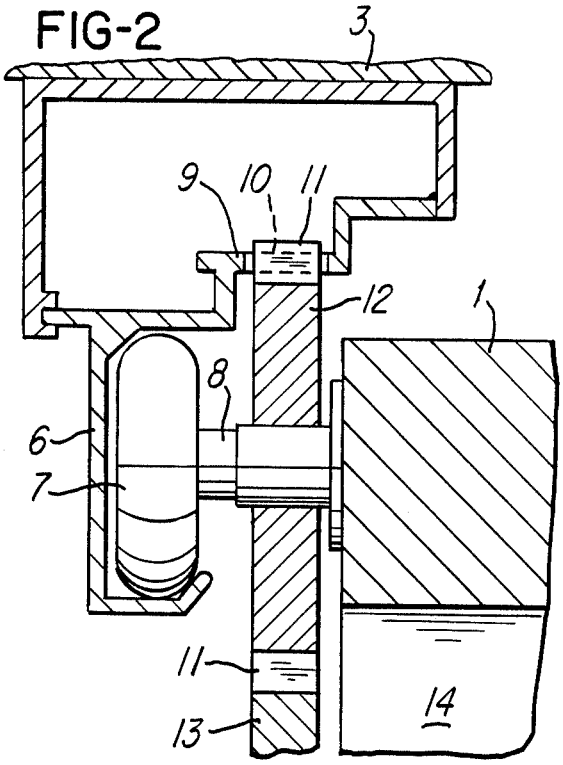
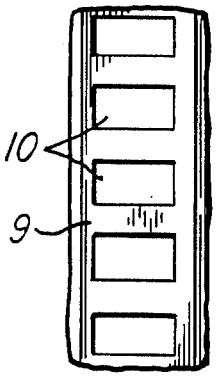
FIG-4
FIG-3
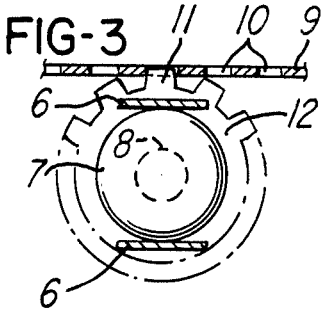

SECTIONAL DOOR WITH OPERATOR

BACKGROUND OF THE INVENTION

1. Field of the Invention

The present invention relates to a gate or door, especially a sectional door, for buildings or the like, having one or more closure elements that at the sides are guided approximately vertically, and that are provided with drive means, whereby these elements can be moved into an approximately horizontal rest position above the door opening.

2. Description of the Prior Art

Pursuant to heretofore known proposals, fixed drive motors are provided that act upon the closure elements, for example via cables. These drive mechanisms are complicated and expensive because the cables can act upon the closure elements only via intermediate elements and compensating elements. In addition, special preventive measures are also indispensable in case the cable breaks.

The object of the present invention is to simplify the drive mechanism for opening and closing the door while for the most part eliminating the aforementioned drawbacks.

SUMMARY OF THE INVENTION

This object is inventively realized in that the drive mechanism for the door now comprises one or more motors that are secured to a given closure element, with a gear wheel driven thereby, with the gear wheel meshing or being in engagement with tracks that are parallel to the lateral guides; this can be effected, for example, by a track or rail that is provided with openings, recesses or holes.

Consequently, rather than using a fixed motor, one (or possibly more) motors are used that are secured to a closure element and therefore move with the closure elements, either upwardly when the door is opened or downwardly when the door is closed. The drive motor is connected either directly with a gear wheel, or is connected with a gear wheel via a drive or gear arrangement. This gear wheel cooperates with a toothed rack or a track that is provided with openings or holes for meshing with the gear wheels. Supply of the generally electrically driven motors can be effected by floating lines or other feed lines.

It is to be understood that a drive mechanism embodied in this manner operates directly, and is therefore is subjected to practically no disruption. For this reason, small drive motors only are required, since the efficiency of a thus embodied drive mechanism is high.

In particular with lateral guides that have curved sections, it is particularly advantageous if the aforementioned toothed drive wheels and the guide wheels be coaxially disposed on both sides of the closure elements. In this way, kinematically favorable conditions result for travelling through the curves. The guide wheel is preferably freely rotatable.

It is furthermore advantageous to have an irreversible drive or gear arrangement between the gear wheel and the drive motor in order to preclude unintentional movements of the closure elements in the event of power failure or if the motor malfunctions. In many instances, such a drive or gear arrangement operates as a protection against having the door crash down.

BRIEF DESCRIPTION OF THE DRAWING

Further particulars of the present invention will be explained with the aid of the drawing, which illustrates one exemplary specific embodiment of the present invention, and in which:

FIG. 1 is a vertical, cross-sectional view through one sectional door,

FIG. 2 is a cross-sectional view taken along the line II—II in FIG. 1,

FIG. 3 is a schematic side view showing the guidance and the drive mechanism for a closure element, and FIG. 4 is a partial view of the track that cooperates with a gear wheel of a drive mechanism.

DESCRIPTION OF PREFERRED EMBODIMENTS

The building opening 2 of the building 3 is closed off by the sectional gate or door, which is illustrated only schematically, and which has sections 1 that are hingedly connected to one another. In order to be able to guide the sections 1 into the vertical operating position, and in order to be able to move these sections back into the inoperative or rest position above the building opening, vertical, approximately C-shaped guides 4 are provided in a customary manner, at the bottom, on both sides of the building opening; via a curved section 5, these guides lead into approximately horizontal sections 6. When the door is closed, the sections 1 are disposed approximately between the vertical sections of the guides 4, whereas when the door is open, the sections 1 are held above the building opening 2 by the sections 6.

The guide rollers 7 associated with each of the sections 1 are freely movably disposed on a spindle or shaft 8 that is rigidly connected to the sections 1. At least in the region of the horizontal sections 6, a track 9 extends parallel to the guides for the guide rollers 7; these tracks, at uniform intervals, are provided with approximately rectangular openings or holes 10 for meshing with the teeth 11 of a gear wheel 12. These gear wheels 12 are coaxial with the guide rollers 7, i.e. are rotatably disposed on the shaft 8. This gear wheel 12, in turn, meshes with a gear wheel 13 that is operatively connected with a worm drive of a subsequently connected electric motor 14. This motor 14 is secured to the inside of the pertaining section 1, and in particular is disposed in that edge region that is proximate to the shaft 8. The electrical feed and control lines are of known construction, and are therefore not illustrated.

One such drive unit can be disposed on each side of the door. However, it is also possible, for example via the shaft of the gear wheel 13, to drive a corresponding gear wheel on the opposite side of the door in order at that location to be able to drive a gear wheel 12 that, in turn, meshes with a track 9. Both drive mechanisms can then be operated synchronously from a single motor 14.

Furthermore, the important thing is that the aforementioned drive mechanism always be disposed on the upper, i.e. back, edge of that closure element (section) that is located at the top when the door is closed. Thus, when the door is being opened, the sections 1 are pulled, and when the door is being closed, in contrast, the last section 1 pushes the remaining sections ahead of it. The inventive drive mechanism can therefore be compared to a rail-guided chain drive that pushes or pulls trucks or carriages.

If the electrical drive mechanism has turned off or is disconnected, in particular, for example, by a defect in the feed line or in the motor, no unintentional movements of the door can occur because the worm drive associated with the motor 14 does not permit reverse movements.

The gear wheels 12, and the rollers 7 that serve to guide the door sections or closure elements 1, can be disposed close together. The rollers 7 can have a smaller effective diameter than do the gear wheels 12.

The guide rail associated with the guide rollers 7, and the track 9 of the gear wheels 12, can be formed from a single, one-piece profiled member in such a way that the rail and the track integrally merge with one another. For approximately horizontally disposed guides and tracks, the operational surfaces of the guides may be disposed at the bottom, and the operational surfaces of the tracks may be disposed at the top.

In place of the track 9, it is also possible to use a toothed rack which, however, is more expensive than is the illustrated track 9.

The present invention is, of course, in no way restricted to the specific disclosure of the specification and drawing, but also encompasses any modifications within the scope of the appended claims.

What I claim is:

1. In a sectional door having a plurality of articulated closure elements that are guided at the sides via guide means, and that are provided with drive means, whereby these closure elements can be moved from an essentially vertical operative position where they close a building opening, into an approximately horizontal rest position above said building opening, and vice versa, the improvement wherein:

said drive means comprises: at least one motor secured directly to an uppermost one of said closure elements; gear wheel means driven by said at least one motor; stationary track means including individual tracks having openings with which the teeth of said gear wheel means mesh; said guide means including horizontal guide means sections, with said individual tracks being disposed integrally therewith; said guide means further including rollers that are freely rotatably supported by said closure elements and cooperate with said horizontal guide means sections to effect guidance of said closure elements; said gear wheel means including gear wheels supported by said uppermost closure element, and at least one of said gear wheels being mounted in coaxial relationship with said guide rollers.

2. A door according to claim 1, in which said gear wheels are respectively disposed close to a given one of said guide rollers.

3. A door according to claim 2, in which said guide rollers have an effective diameter that is less than that of said gear wheels.

4. A door according to claim 1, which includes a gear wheel on each side of said given one of said closure elements, with both of said gear wheels being rigidly interconnected; and which includes a single motor for driving both of said gear wheels.

5. A door according to claim 1, in which a given horizontal guide means section, and an associated track means, are formed by a one-piece profiled member.

6. A door according to claim 1, in which operational surfaces of said horizontal guide means sections are disposed below the operational surfaces of said track means.

* * * * *